US008550745B2

(12) United States Patent
Thompson

(10) Patent No.: US 8,550,745 B2
(45) Date of Patent: Oct. 8, 2013

(54) APPARATUS AND METHOD FOR COMPACTING AND CONDITIONING A TRACT OF GROUND

(75) Inventor: Calvin Thompson, Dallas, GA (US)

(73) Assignee: Rockland, Inc., Bedford, PA (US)

( * ) Notice: Subject to any disclaimer, the term of this patent is extended or adjusted under 35 U.S.C. 154(b) by 1452 days.

(21) Appl. No.: 11/400,508

(22) Filed: Apr. 10, 2006

(65) Prior Publication Data

US 2006/0239776 A1 Oct. 26, 2006

Related U.S. Application Data

(60) Provisional application No. 60/674,500, filed on Apr. 25, 2005.

(51) Int. Cl.
*E01C 19/26* (2006.01)

(52) U.S. Cl.
USPC ..... 404/124; 172/537; 172/518; 172/540

(58) Field of Classification Search
USPC ..... 172/518, 537, 540, 542, 554, 45, 172/551, 552, 612; 37/301, 302, 303, 189, 37/462, 465, 347, 352, 238, 242, 386, 403, 37/91; 404/124
See application file for complete search history.

(56) References Cited

U.S. PATENT DOCUMENTS

| | | | | | |
|---|---|---|---|---|---|
| 822,752 | A | * | 6/1906 | Moore | 172/540 |
| 953,546 | A | | 3/1910 | Pennington | |
| 1,548,395 | A | * | 8/1925 | Tarbell | 172/714 |
| 1,560,295 | A | * | 11/1925 | Keeler | 404/124 |
| 1,591,396 | A | * | 7/1926 | Mills | 171/53 |
| 1,763,769 | A | * | 6/1930 | Fischer | 37/189 |
| 1,801,923 | A | | 4/1931 | Kella | |
| 2,685,751 | A | * | 8/1954 | Bain | 37/247 |
| 3,302,540 | A | * | 2/1967 | Fuentes, Jr. | 404/127 |
| 3,595,411 | A | | 7/1971 | Ables | |
| 3,704,575 | A | * | 12/1972 | Daniel et al. | 56/12.7 |
| 3,741,311 | A | * | 6/1973 | Fleurant | 172/45 |
| 3,891,342 | A | | 6/1975 | Roe | |
| 4,023,288 | A | | 5/1977 | Roe | |
| 4,079,791 | A | | 3/1978 | Yoder et al. | |
| 4,100,688 | A | | 7/1978 | Grist | |
| 4,134,221 | A | | 1/1979 | Scodeller | |
| 4,193,457 | A | * | 3/1980 | Sphar | 172/810 |
| 4,237,984 | A | | 12/1980 | Cobb et al. | |
| 4,260,027 | A | * | 4/1981 | Langan | 172/45 |
| 4,278,368 | A | | 7/1981 | Livesay | |
| 4,339,908 | A | | 7/1982 | Johnson | |
| 4,411,081 | A | | 10/1983 | King | |
| 4,490,070 | A | | 12/1984 | Upchurch et al. | |
| 4,516,639 | A | | 5/1985 | Hammarlund et al. | |
| 4,632,599 | A | | 12/1986 | Sadahiro | |
| 4,702,643 | A | | 10/1987 | Thilmony | |
| 4,723,870 | A | | 2/1988 | Martinez | |

(Continued)

*Primary Examiner* — Matthew D Troutman
(74) *Attorney, Agent, or Firm* — Novak Druce Connolly Bove + Quigg LLP

(57) ABSTRACT

An apparatus for compacting and conditioning a tract of ground generally consisting of a machine; means mounted on the machine for maneuvering an implement mounted thereon along and in contact with the tract of ground; and an implement mounted on the maneuvering means of the machine movable along and in contact with the tract of ground including a frame attachable to the maneuvering means of the machine, a drum rotatably mounted on the frame and a plurality of segments comprised of loosely connected components disposed transversely and spaced circumferentially on the drum.

5 Claims, 3 Drawing Sheets

(56) References Cited

U.S. PATENT DOCUMENTS

| | | | | | |
|---|---|---|---|---|---|
| 4,808,027 | A | * | 2/1989 | Anderson | 404/127 |
| 4,852,277 | A | | 8/1989 | Ward | |
| 4,862,969 | A | * | 9/1989 | Jobst et al. | 172/45 |
| 4,892,155 | A | | 1/1990 | Wanamaker | |
| 4,950,102 | A | | 8/1990 | Zeitz | |
| 4,974,349 | A | | 12/1990 | Timmons | |
| 5,097,610 | A | | 3/1992 | Bishop | |
| 5,212,892 | A | * | 5/1993 | Maitlen et al. | 37/329 |
| 5,511,368 | A | | 4/1996 | Kocher | |
| 5,526,590 | A | | 6/1996 | Palm et al. | |
| 5,555,652 | A | * | 9/1996 | Ashby | 37/189 |
| 5,592,761 | A | | 1/1997 | Ward | |
| 5,725,057 | A | | 3/1998 | Taylor | |
| 5,823,238 | A | | 10/1998 | Bohnke | |
| 5,921,337 | A | | 7/1999 | Okamoto | |
| 5,992,483 | A | | 11/1999 | Bohnke | |
| 6,056,066 | A | | 5/2000 | Wells et al. | |
| 6,193,444 | B1 | * | 2/2001 | Jonninen | 405/258.1 |
| 6,484,813 | B2 | | 11/2002 | Tapio et al. | |
| 6,539,697 | B2 | * | 4/2003 | Burk | 56/504 |
| 6,626,499 | B1 | | 9/2003 | Schenk et al. | |
| 2004/0187364 | A1 | | 9/2004 | Archuleta, Jr. et al. | |
| 2007/0086861 | A1 | * | 4/2007 | Pratt | 404/124 |

* cited by examiner

APPARATUS AND METHOD FOR COMPACTING AND CONDITIONING A TRACT OF GROUND

This application claims priority from U.S. Provisional Patent Application No. 60/674,500, filed Apr. 25, 2005, herein incorporated by reference in its entirety.

This invention relates to an apparatus and method for compacting and conditioning a tract of ground. The invention further contemplates an apparatus which particularly is effective in compacting a sloped terrain of ground and conditioning such ground to form depressions in the surface thereof in which seeds of vegetation sowed thereon will be captured to facilitate germination.

BACKGROUND OF THE INVENTION

In the construction of roadways, tracts of ground along surfaced roads often are sloped which require that such tracts be graded, compacted and provided with a ground cover to prevent soil erosion. Typically, after such tracts are graded and compacted, they are seeded to grow a cover of grass. Preparatory to seeding, such tracts are not only graded and compacted but further are conditioned by providing the compacted soil with depressions or crevices which serve to capture and retain seed that has been sown, in order to promote accelerated germination and an early ground cover.

In the past, in has been the conventional practice to condition such tracts for seeding by operating crawler tractors over the ground so that the projecting cleats of the crawler tracks of the machines form depressions or crevices in the soil. Such practice of operating such tractors ever sloped terrain, however, has been found to be not only time consuming and unproductive but often hazardous. Accordingly, it has been found to be desirable to provide an improved apparatus and method of compacting and conditioning a tract of ground, and particularly a sloped tract of ground, to provide a uniform pattern of depressions or crevices in the compacted soil, into which sown seeds of a cover such as grass may be captured and retained, which is simple in design and use, effective in performance and productive in operation.

SUMMARY OF THE INVENTION

The principal object of the present invention is achieved by providing an apparatus for compacting and conditioning tracts of ground, generally consisting of a mobile support means such as an excavating machine or a front end loader; means mounted on the mobile support means for maneuvering an implement mounted thereon along and in contact with the tract of ground, such as a dipper stick or a boom; and an implement mounted on the maneuvering means, movable along and in contact with the tract of ground, including a frame attachable to the maneuvering means, a drum rotatably mounted on such frame and a plurality a segments of loosely connected components disposed transversely and spaced circumferentially on such drum. Preferably, such drum is provided with a plurality of transversely disposed, circumferentially spaced cleats, and such segments of loosely connected components comprise chains each disposed loosely between successive cleats. In a further specific embodiment of the invention such implement further is provided with a pair of circumferentially disposed chains each secured to one set of ends of the transversely disposed set of chains and received in recesses formed in a set of ends of such cleats.

DETAILED DESCRIPTION OF THE PREFERRED EMBODIMENT OF THE INVENTION

Figure 5A:
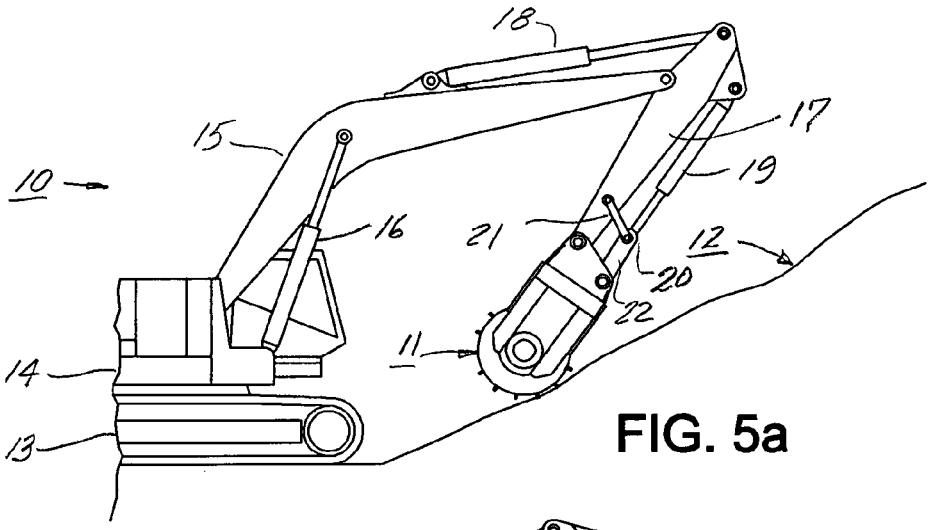
FIG. 5*a* is a side elevational view of an excavating machine equipped with an implement as shown in FIGS. 1-4, illustrating the machine and implement in a starting position for compacting and conditioning a tract of sloped terrain.
Figure 5B:
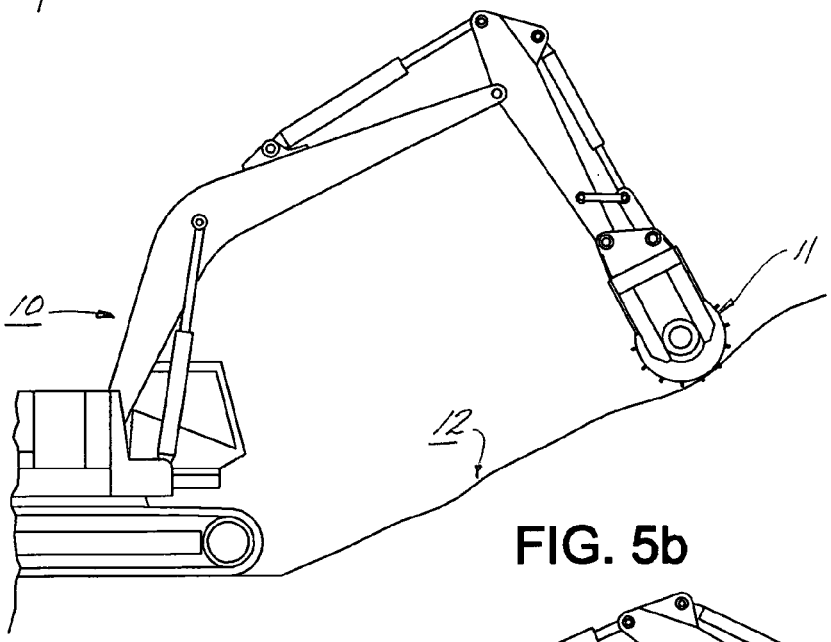
FIG. 5*b* is a view similar to the view shown in FIG. 5*a*, illustrating the machine and implement in a sequential position in compacting and conditioning such tract of terrain.
Figure 5C:
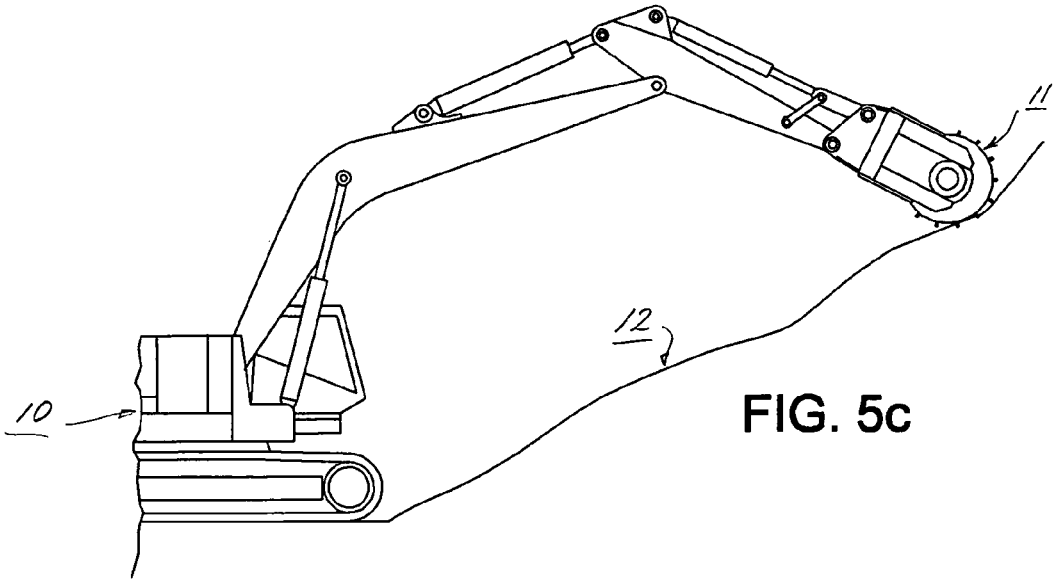
FIG. 5*c* is a view similar to the views shown in FIGS. 5*a* and 5*b*, illustrating the machine and implement in a still further sequence of operation, in compacting and conditioning such tract of terrain.

Referring to FIGS. 5*a* through 5*c* of the drawings, there is illustrated an excavating machine 10 having an implement 11 attached thereto which are operable to compact and condition a tract of sloped terrain 12 for seeding to provide a vegetative cover. Machine 10 is of a conventional construction including a lower crawler tractor assembly 13, an upper frame structure 14 pivotally mounted on the lower crawler assembly, for rotational movement about a vertical axis, a boom 15 pivotally mounted on the upper frame structure for pivotal movement about a horizontal axis, a hydraulic cylinder assembly 16 operatively interconnecting the upper frame structure and the boom for lifting and lowering the boom, a dipper stick 17 pivotally connected to the outer end of boom 15, a hydraulic cylinder assembly 18 operatively interconnecting the boom and an end of the dipper stick for pivoting the dipper stick relative to the boom about a horizontal axis and a hydraulic cylinder assembly 19 pivotally connected at a base end thereof to a set of brackets disposed on the upper end of the dipper stick and connected at the rod end thereof to a pin 20 having a set of support links, 21 pivotally connected thereto and an actuating link 22 also pivotally connecting thereto.

Figure 1:
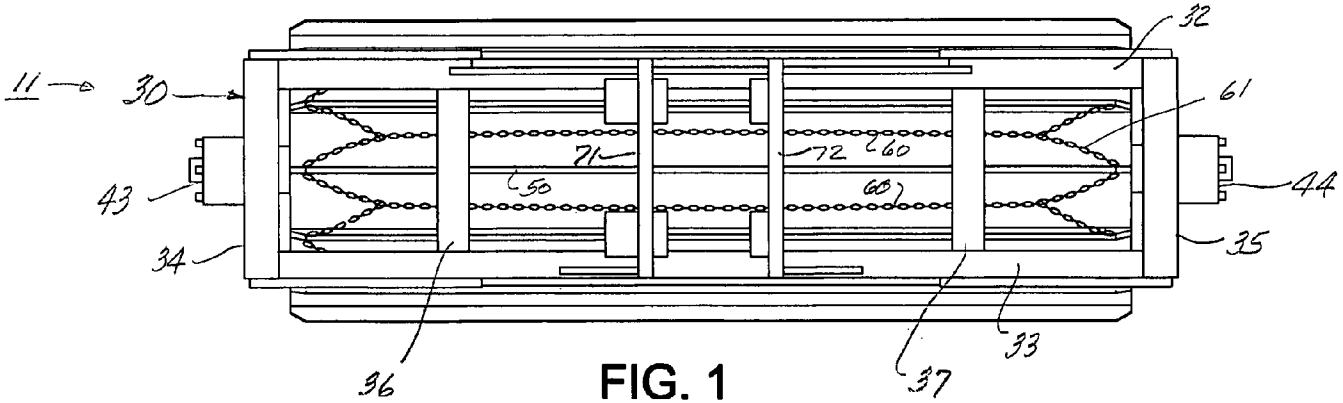
FIG. 1 is a top plan view of an implement for compacting and conditioning a tract of ground, embodying the present invention.
Figure 3:
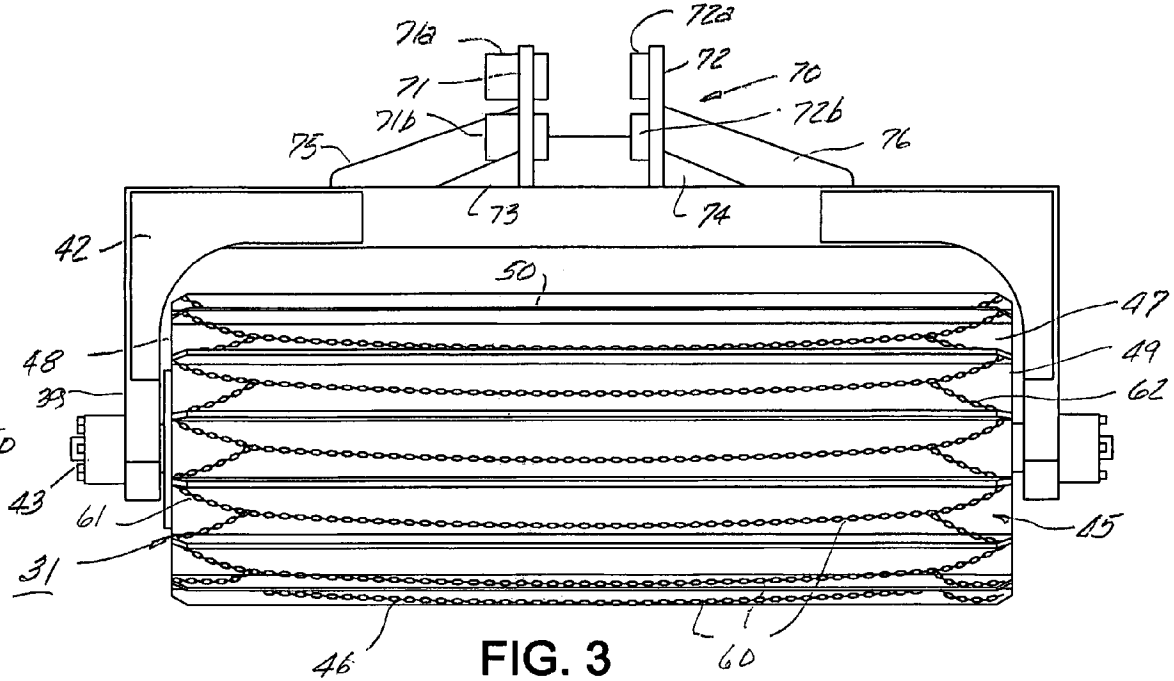
FIG. 3 is a front elevational view of the implement shown in FIGS. 1 and 2.
Figure 2:
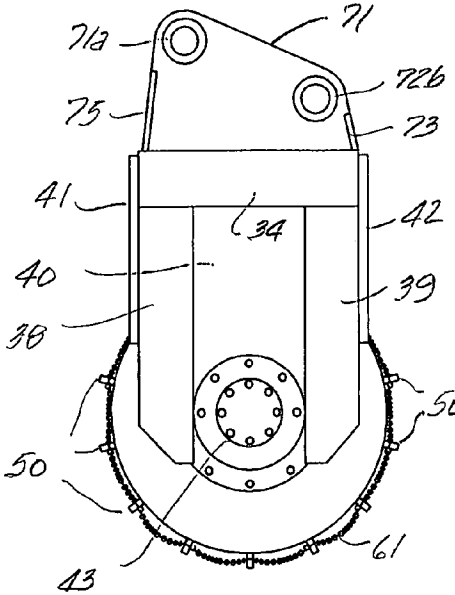
FIG. 2 is a side elevational view of the implement shown in FIG. 1.
Figure 4:
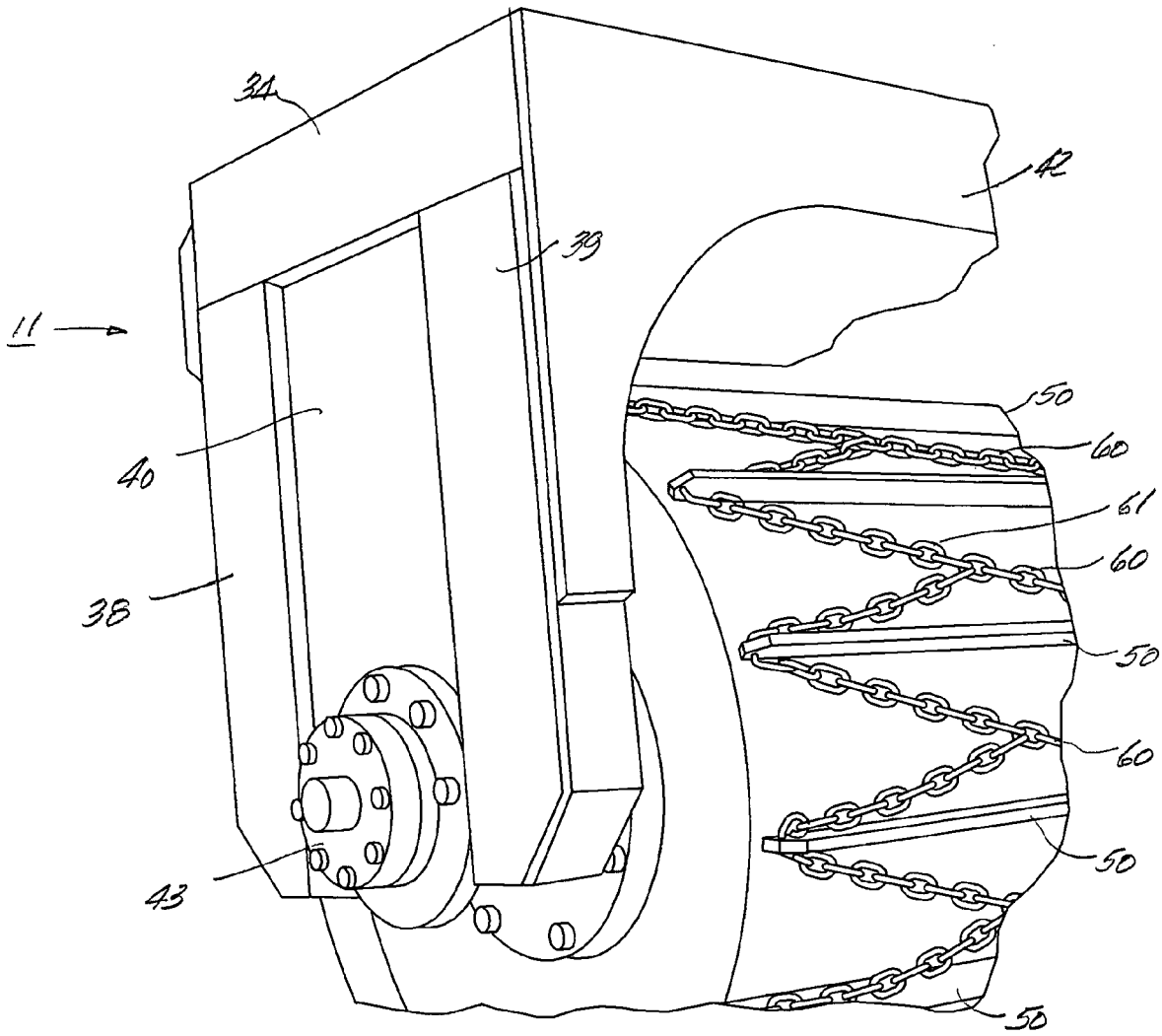
FIG. 4 is an enlarged perspective view of the implement shown in FIGS. 1 through 3, having portions thereof broken away.

As best shown in FIGS. 1 through 3, implement 11 generally consists of a frame 30 pivotally connectable to the free end of dipper 17 and actuating link 22, and a drum assembly 31 mounted on frame 30. Frame 30 includes a pair of longitudinally spaced, transversely disposed members 32 and 33 interconnected at the ends thereof by a pair of members 34 and 35, and a set of members 36 and 37 disposed between end numbers 34 and 35. Depending from end number 34 is a pair of structural members 38 and 39 provided with a plate member 40 disposed on the inner sides thereof, and a pair of L-shaped plate members 41 and 42 secured to members 32 and 33 and the front and rear surfaces of depending structural members 38 and 39. End member 35 is provided with a similar set of depending structural members, a plate member secured to the inner sides thereof, and a set of L-shaped plate members secured to the sides of structural members 32 and 33 and the front and rear faces of the depending structural members thereof. Mounted on plate member 40 and the comparable plate member on the other side of the implement is a pair of housings 43 and 44 in which there is provided a pair of axially aligned bearings.

Drum assembly 31 includes a drum 45 and a chain assembly 46 secured to but loosely carried on drum 45. The drum consists of a cylindrical member 47 closed at its ends by a pair of circular plate members 48 and 49, and a shaft journaled in the bearings provided in housings 43 and 44. The surface of cylindrical member 47 of the drum is provided with a plurality of circumferentially spaced, transversely disposed and substantially radially projecting cleats 50.

Chain assembly 46 consists of a plurality of chain segments 60 each disposed between and extending loosely along a pair of successive cleats 50, and a set of chain segments 61 and 62 each extending about the cylindrical surface of drum 47 and connected to a set of ends of chain segments 60. Each of such segments 61 also is trained around the ends of cleats 50 and may be secured to such ends by any suitable means. The ends of cleats 50 may be formed with a recess for receiving such end chains openings through which such end chains may pass or any other suitable means for securing such chain segments to the drum but permitting them to be carried loosely between the cleats. The connections of end chains 61 and 62 to chain segments 60 also may be by any means including having the links thereof linked together or otherwise connected thereto.

Drum assembly 31 is partially mounted within frame 30 with the lower end thereof projecting below the lower ends of frame 30 so that when the implement is rolled along a tract of ground, the drum assembly will be free to rotate within frame 30 and engage the ground at the lower end thereof.

Implement 11 may be detachably connected to dipper stick 17 and actuating link 22 of machine 10 or to similar components of other machines including front end loaders, by means of a mounting assembly 70 provided at the upper intermediate portion of frame 30. Such assembly includes a pair of longitudinally disposed, transversely spaced mounting brackets 71 and 72 provided with a first set of connecting pin receiving collars 71*a* and 72*a* and a second set of connecting pin receiving collars 71*b* and 72*b*. Mounting brackets 71 and 72 further are reinforced by a first set of brackets 73 and 74 connected to structural frame member 33, and brackets 75 and 76 connected to structural frame number 32.

With the implement disposed in the upright position as shown in FIG. 3, it may be attached to the front end assembly of machine 10 by positioning the machine adjacent the implement, manipulating the front end assembly of the machine to insert the free ends of the dipper stick and actuating link between mounting brackets 71 and 72 of the implement, with the connecting pin openings thereof in registry with the openings in the mounting brackets, and then inserting and securing connecting pins in the registered openings. The apparatus then may be used to compact and condition a sloped tract of terrain to prepare it for seeding. As shown in FIGS. 5*a* through 5*c*, the apparatus may be maneuvered to a position adjacent and either above or below the sloped tract of ground, and the front end assembly may be maneuvered to roll the drum of the implement up and down along the sloped tract. As the drum traverses the sloped tract, the ground will be compacted and both the cleats and the chain segments of the drum will penetrate the compacted soil to form depressions or crevices along the surfaces thereof. A stretch along a roadway may thus be worked by simply advancing the machine along such stretch and operating the front end assembly to compact and condition the ground for seeding. Once the tract of ground has thus been compacted and conditioned, grass seed or perhaps some other form of vegetative seed may be sown on the conditioned ground. Because of the conditioning of the surface of the tract, such sown seed will be caused to be captured and retained in the depressions and crevices of the ground surface. With the seed thus captured and retained, and the advent of rainfall, such seed will quickly germinate and sprout to provide a ground cover on the tract. Such ground cover will then prevent erosion of soil on the tract.

Although it is preferred to use a steel chain mounted on the drum as described, other similarly configured strands may be utilized, secured to the drum by other means. Such strands, however, should have a configuration sufficient to penetrate the ground surface and form depressions or crevices therein, and should be loosely attached to provide a random pattern of such depressions and cavities. The loose nature of the claim segments disposed between the cleats further functions to prevent soil from becoming lodged between the cleats. The implement as described may be mounted on and used with any type of machine provided with a front end assembly which can be maneuvered to roll the drum of the implement over the tract of ground to be compacted and conditioned for seeding.

From the foregoing detailed description, it will be evident that there are a number of changes, adaptations and modifications of the present invention, which come within the province of those persons having ordinary skill in the art to which the aforementioned invention pertains. However, it is intended that all such variations not departing from the spirit of the invention be considered as within the scope thereof as limited solely by the appended claims.

I claim:

1. An implement mountable on a machine operable to maneuver said implement along a tract of ground to compact and condition said ground, comprising:

a drum rotatably mountable on said machine;

a plurality of cleats disposed transversely and spaced circumferentially on said drum;

a plurality of segments comprised of loosely connected components, each loosely, transversely disposed between a successive pair of said cleats; and a pair of connecting segments each disposed circumferentially on said drum and connected to a set of ends of said first mentioned segments.

2. The implement according to claim 1 wherein said connecting segments comprise chains.

3. The implement according to claim 1 wherein each of said connecting segments includes a plurality of sections, each of which is trained about an end of one of said cleats, having end portions thereof connected to ends of a pair of said first mentioned segments disposed on opposite sides of a cleat.

4. The implement according to claim 1 wherein said first mentioned segments comprise chains and said end portions of said connecting segments are linked to said ends of said first mentioned segments.

5. The implement according to claim 1 wherein each of said sections of each of said connecting segments in secured to an end of a cleat.

* * * * *